US006658817B1

(12) United States Patent
Eve et al.

(10) Patent No.: US 6,658,817 B1
(45) Date of Patent: Dec. 9, 2003

(54) METHOD AND APPARATUS FOR PACKAGING PRODUCTS WITH DIFFERENT MARKINGS

(75) Inventors: Richard William Eve, Cambridge (GB); William Ronald Stuart Baxter, Cambridge (GB)

(73) Assignee: Inca Digital Printers Limited, Cambridge (GB)

( * ) Notice: Subject to any disclaimer, the term of this patent is extended or adjusted under 35 U.S.C. 154(b) by 0 days.

(21) Appl. No.: 09/787,684

(22) PCT Filed: Sep. 20, 1999

(86) PCT No.: PCT/GB99/02913

§ 371 (c)(1),
(2), (4) Date: Jun. 25, 2001

(87) PCT Pub. No.: WO00/17056

PCT Pub. Date: Mar. 30, 2000

(30) Foreign Application Priority Data

Sep. 21, 1998 (EP) ..... 98307640

(51) Int. Cl.[7] ..... B65B 61/02; B65B 21/06; B65B 35/30; B65B 61/20

(52) U.S. Cl. ..... 53/411; 53/443; 53/131.4

(58) Field of Search ..... 53/411, 131.2, 53/131.4, 443, 531; 101/42, 43; 400/120.1

(56) References Cited

U.S. PATENT DOCUMENTS 4,332,193 A * 6/1982 Noyes ..... 53/131.3
4,655,026 A 4/1987 Wigoda
4,972,657 A * 11/1990 McKee ..... 53/411
5,199,710 A 4/1993 Lamle
5,680,742 A * 10/1997 Hidding ..... 53/411
5,706,928 A 1/1998 Neukam
5,715,653 A * 2/1998 Weinmann et al. ..... 53/131.2
6,070,391 A * 6/2000 Honegger ..... 53/131.2
6,415,582 B2 * 7/2002 Graushar et al. ..... 53/411

FOREIGN PATENT DOCUMENTS

| | | |
|---|---|---|
| EP | 0088630 | 9/1983 |
| EP | 0200454 | 11/1986 |
| EP | 0618141 | 10/1994 |
| JP | 08119239 | 5/1996 |
| WO | WO 92/00879 | 1/1992 |
| WO | WO 94/15840 | 7/1994 |
| WO | WO 97/27053 | 7/1997 |
| WO | WO 98/09598 | 3/1998 |

* cited by examiner

*Primary Examiner*—Anthony D. Stashick
(74) *Attorney, Agent, or Firm*—Michael Best & Friedrich LLP

(57) ABSTRACT

A method of and apparatus for producing a mixed batch of consumer products without the use of a mechanical mixer to carry out the mixing. An image sequencing means is provided which sequences images to be printed by a digitally-controlled printhead. Varying images are placed on consumer products or parts thereof—e.g. cigarette cards—as those products or parts of products pass under the printhead at a point in the production line. The consumer products, once assembled, are packaged directly from the production line to form mixed batches of product—without an additional mixing step.

25 Claims, 1 Drawing Sheet

METHOD AND APPARATUS FOR PACKAGING PRODUCTS WITH DIFFERENT MARKINGS

FIELD OF THE INVENTION

The present invention relates to methods for producing batches of containers or products wherein each batch consists of containers or products carrying a variety of differing printed images. In particular, the present invention relates to the printing of a wide variety of colour images onto the packaging of goods, such as consumer goods, or alternatively direct onto the goods themselves and producing batches of such goods such that the goods are mixed in mixed batches.

BACKGROUND ART

Children—and many adults—enjoy collecting. A way in which to make this easy is to incorporate "collectables" as images on products or their packaging. Examples are cigarette cards and the picture cards in some tea packs. It would be advantageous to print such images on the external packaging of the product or even on the products themselves, but this has not been widely done because it is difficult to print short runs and then mix them up so that the purchaser has a choice at the point of sale.

Prior art systems exist for mixing containers or products into batches such that each batch consists of containers or products carrying a variety of differing printed images. Such prior art systems are large and complex and the mixing operation necessarily occurs after the containers or products are ready for sale.

One way of avoiding the need to mix whole containers or products is to mix pre-printed images on, for instance, cards, which are inserted into a product package such as a tea or cigarrette pack. Such mixing is relatively easy and quick to do (as compared to mixing whole containers or products). Such cards can, for instance, be mixed manually as they are loaded into a stack on the insertion machinery. See, for example, EP-A-0537149.

Another example of this manner of getting around the problems of the prior art is the use of labels which may be applied at the end of a production and packaging process. Again, it is relatively simple to mix a selection of labels and then apply them or even to print the labels just prior to the time of application. Examples of such systems are given in EP-A-0732267, EP-A-0677013.

Prior art systems also exist for printing low-quality, information-bearing labels (such as bar codes) onto products or their containers on the packaging line. See, for example, EP-A-0618141, EP-A-0088630.

Also known are relatively slow printing systems which produce printed images on demand—such as office computer printers or even a method of producing playing cards in a random sequence at a casino playing table (see U.S. Pat. No. 5,199,710). Such systems are not used to produce packaging for consumer goods since their speed of operation is too slow for industrial requirements.

Known techniques of high-quality, colour printing on products or product packaging require a lengthy set-up process to change an image which is being printed. The cheaper methods of printing (e.g. flexographic, gravure and offset litho) also require a substrate to be in sheet or web form so that it can be pressed onto rollers which carry the ink.

These restrictions of known techniques mean that it is difficult or expensive to print short runs, i.e. small quantities, of any given image, because the set-up time can exceed the printing time. The restrictions also mean that it is even more expensive to print onto the products themselves, unless those products happen to be in sheet or web form (e.g. when the products themselves consist of letters or the like).

Thus in prior art packaging systems, printed material (for instance packaging film) is printed with many copies of a single image before switching to another image. The same system also applies when images are printed directly onto a product. Thus, when products are manufactured and packaged using prior art systems, it is not practical to change the packaging material frequently.

With prior art systems, it is therefore not economically viable to mix a large number of images on, for instance, a point-of-sale box containing sweets. To do this, the manufacturer would have to carry large stocks of the product each with one type of image, and then mix them into each point-of-sale box. Such an operation would be expensive and would occupy a large space if more than a few different images were to be used.

Thus, using prior art packaging systems, products cannot be economically produced having a variety of images within a single batch.

The object of the present invention is to provide an industrial packaging system which allows a batch of products to be produced in an economically viable way such that each batch contains products which have different images printed on them.

A further object of the present invention is to provide a method of producing a packaged or unpackaged product in such a way that each product coming off of a production line may have a different image printed onto it (or its packaging).

SUMMARY OF THE INVENTION

The present invention provides a production, mixing and packaging method which produces a plurality of mixed groups of consumer products, wherein each of said mixed groups of consumer products comprises at least two consumer products which differ from each other in that at least a part or component of one of the at least two consumer products has an image printed onto it which is different from an image printed onto at least a part or component of another of the at least two consumer products, which said production, mixing and packaging method comprises the steps of (a) providing at least one digitally-controlled printhead at a point in a production line such that said printhead is able to print onto at least a part or component of a consumer product as it passes the or each printhead; (b) providing an image storing means which contains data relating to a plurality of different images; (c) providing an image sequencing means which sets a sequence in which said stored images are to be printed thereby determining the mix of consumer products in each mixed group of consumer products; (d) digitally controlling the printhead to print said images onto at least parts or components of a consumer products as it passes the or each printhead based on the data in the image storing means as sequenced by the image sequencing means; (e) if required, assembling a consumer product from their constituent parts or components—including the printed part(s) and/or component(s); (f) packaging a plurality of (assembled) consumer products into a single unit in order to produce one of the plurality of mixed groups of consumer products; and (g) repeating steps (d), (e) and (f), whereby, the plurality of mixed groups of consumer products are produced, mixed and packaged without there being a step of mechanically mixing products or parts or components thereof.

The present invention elegantly overcomes the problems of prior art production systems.

Further objects and advantages of the present invention will become apparent from the ensuing description and drawings.

DETAILED DESCRIPTION OF THE INVENTION

Figure 1:
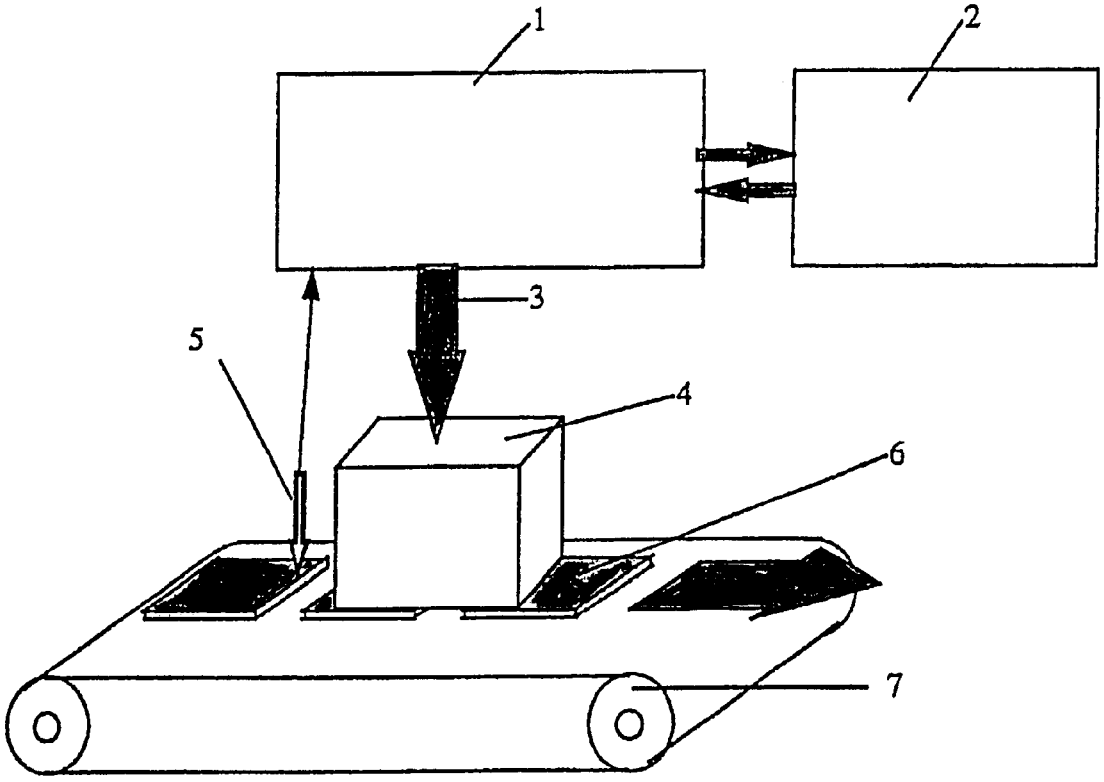
FIG. 1: System overview of the current invention

The present invention overcomes the problems of the prior art by using a digital printer which is capable of printing a different image on each product or package at industrial packaging speeds. Although such printers do exist (for instance, using the printhead produced by XaarJet of Cambridge, UK), they have not, in the prior art, been used for producing products which have different images on them or their packaging within the same production run. This is probably due to a technical prejudice within the field—based on the erroneous belief that such a system would not be operable.

If there are, for instance, 1000 images in the series, then such a printer can be programmed to print image 1, then 2, 3, 4 . . . 999, 1000, and then back to image 1. Alternatively it can be programmed to randomise the print order, or to apply some other rule (making some images more common than others). Because the images are mixed this way in production, they will remain well mixed through the secondary packaging and distribution system even if buffers are used. The point-of-sale containers will always contain a mix of images.

The present invention has the following additional advantages:

- it can be used to provide rare "prizewinning" images
- switching from one series of images to another is as easy as switching from one image to another, so it is easy to keep up with current trends (e.g. fashionable pop stars, characters in current films).
- different products can each have their own range of images, for instance different types of pasta in the same pack can each have a distinct range of recipes from which the shopper can choose.

The present invention is unique because it allows the images to be printed using high quality full colour, in an order which is controllable by the manufacturers (e.g. serial, specified frequency or randomised). This is achieved by the use of inkjet printing technology with a control system that is able to 'store and select the images in real time for printing according to specified rules. Images which consist only of text may also be used (e.g. 'tip of the day' on a cooking ingredient package).

FIG. 1 shows a system overview for a packaging system according to the invention. Packaged or unpackaged products (6) travel past a printer (4). A detector (5) may be used to ensure an image is registered correctly onto the product. Digital print image data (3) is passed to the printer (4) from the image sequencing unit (1). This unit (1) takes images from the Image Store (2)) and sends them to the printer (4) in the required sequence.

In an alternative embodiment (not shown) the sequencer (1) may specify images to be printed which are then sent directly from the Image Store (2) to the printer (4) (in either case through a buffer).

Sequencing may be decided at run time following some rules on distribution (e.g. 1% of image A, 10% of image B, 89% of image C, image A always separated from another A by at least 10 items, etc.) or it may be taken from a pre-prepared file describing the sequence.

The image may itself be made up of sub-images each of which is configurable, and the position of the images on the product may also be variable from one item to another.

What is claimed is:

1. A production, mixing and packaging method that produces a plurality of mixed groups of consumer products, wherein each of the mixed groups of consumer products comprises at least two consumer products that differ from each other in that at least a part or component of one of the at least two consumer products has an image printed on it that is different from an image printed on at least a part or component of another of the at least two consumer products, the method comprising:

a. providing at least one digitally-controlled printhead at a point in a production line such that the printhead is able to print on at least a part or a component of a consumer product as it passes the at least one printhead;

b. providing an image storage device that contains data relating to a plurality of different images;

c. providing an image sequencer that sets a sequence in which the stored images are to be printed, thereby determining the mix of consumer products in each mixed group of consumer products;

d. digitally controlling the printhead to print the images on at least a part or a component of a consumer product as it passes the at least one printhead based on the data in the image storage device as sequenced by the image sequencer; and e. packaging a plurality of consumer products into a single unit in order to produce one of the plurality of mixed groups of consumer products;

whereby, the plurality of mixed groups of consumer products are produced, mixed and packaged without there being a step of mechanically mixing products or parts or components thereof.

2. A method according to claim 1 wherein at least some of the consumer products include constituent parts or components and further comprising the step of, prior to step e, assembling the at least some of the consumer products from their constituent parts or components.

3. A production, mixing and packaging method according to claim 2 wherein providing at least one digitally-controlled printhead at a point in a production line includes locating the printhead at a point in the production line separate from an assembly section of the production line, and further comprising printing the images on a web that is subsequently transferred to the assembly section of the production line for assembly into an assembled consumer product.

4. A production, mixing and packaging method according to claim 1 wherein providing at least one digitally-controlled printhead at a point in a production line includes providing a drop-on-demand ink-jet printhead.

5. A production, mixing, and packaging method according to claim 1 wherein providing an image storage device includes providing decorative images that may be used for promotional purposes.

6. A method according to claim 1 wherein providing an image storage device includes providing images that include text.

7. A method according to claim 1 including the step of printing the images in an ordered sequence.

8. A method according to claim 1 including the step of printing the images in a random order.

9. A method according to claim 1 including the step of printing the images in a sequence whereby a certain image is printed with greater frequency than another.

10. A method of producing a group of consumer products, the group of consumer products comprising at least two consumer products that differ from each other in that at least a part or a component of one of the at least two consumer products has an image printed on it that is different from an image printed on at least a part or a component of another of the at least two consumer products, the method comprising:

a. setting a sequence of stored images to be printed, thereby determining the mix of consumer products in the group of consumer products;

b. printing images of the sequence of stored images, using a digitally-controlled printhead, on at least a part or a component of the at least two consumer products;

whereby, the group of consumer products is produced without there being a step of mechanically mixing products or parts or components thereof.

11. An apparatus for the production of a plurality of mixed groups of consumer products, wherein each of the mixed groups of consumer products comprises at least two consumer products that differ from each other in that at least a part or a component of one of the at least two consumer products has an image printed on it that is different from an image printed on at least a part or a component of another of the at least two consumer products, the apparatus comprising:

a. at least one digitally-controlled printhead arranged at a point in a production line such that the at least one printhead may print on at least a part or a component of a consumer product as it passes the at least one printhead;

b. an image storing device for containing data relating to a plurality of different images;

c. an image-sequencer adapted to set a sequence in which the stored images are to be printed;

d. a control device for digitally controlling the printhead to print the images on at least a part or a component of a consumer product as it passes the at least one printhead based on the data in the image storing device as sequenced by the image sequencer; and e. a packaging device for packaging a plurality of consumer products into a single unit in order to produce one of the plurality of mixed groups of consumer products;

whereby, the apparatus is adapted such that the plurality of mixed groups of consumer products are produced, mixed and packaged without there being a step of mechanically mixing products or parts or components thereof.

12. An apparatus according to claim 11 wherein at least some of the consumer products include constituent parts or components and further comprising an assembly device for assembling at least one of the consumer products from its constituent parts or components.

13. An apparatus according to claim 11 wherein the image sequencer is programmed to print the images in an ordered sequence.

14. An apparatus according to claim 11, wherein the image sequencer is programmed to print the images in a random sequence.

15. An apparatus according to claim 11, wherein the image sequencer is programmed to print the images in a sequence whereby a certain image is printed with a greater frequency than another.

16. An apparatus for producing a group of consumer products, the group of consumer products comprising at least two consumer products that differ from each other in that at least a part or a component of one of the at least two consumer products has an image printed on it that is different from an image printed on at least a part or a component of another of the at least two consumer products, the apparatus comprising:

a. a processor for setting a sequence of stored images to be printed thereby determining the mix of consumer products in the group of consumer products;

b. a digitally-controlled printhead;

c. a control device for effecting the printing of images of the sequence of stored images using the printhead, on at least a part or a component of the at least two consumer products;

whereby, the group of consumer products is produced without there being a step of mechanically mixing products or parts or components thereof.

17. A delivery method for delivering mixed groups of consumer products to a consumer-sales outlet, the method comprising:

a. providing at least one digitally-controlled printhead at a point in a production line such that the printhead is able to print on at least a part or a component of a consumer product as it passes the at least one printhead;

b. providing an image storage device that contains data relating to a plurality of different images;

c. providing an image sequencer that sets a sequence in which the stored images are to be printed, thereby determining the mix of consumer products in each mixed group of consumer products;

d. digitally controlling the printhead to print the images on at least a part or a component of a consumer product as it passes the at least one printhead based on the data in the image storage device as sequenced by the image sequencer;

e. packaging a plurality of consumer products into a single unit in order to produce one of the plurality of mixed groups of consumer products; and f. transporting at least one mixed group of consumer products, via a distribution chain, to a consumer sales outlet.

whereby, the plurality of mixed groups of consumer products are produced, mixed, packaged, and delivered without there being a step of mechanically mixing products or parts or components thereof.

18. A method of printing batches of products wherein each of the batches includes at least two products that differ from each other in that at least a part or a component of one of the at least two products has an image printed on it that is different than at least a part or a component of another of the at least two products, the method of printing comprising:

a. positioning at least one printer at a point in a production line such that the printer is able to print on at least a part or a component of a product as it passes the at least one printer;

b. providing a plurality of different images;

c. sequencing the images in a sequence in which the images are to be printed on the products thereby determining the mix of products in each batch; and d. controlling the at least one printer to print the images on at least a part or a component of the product as it passes the at least one printer in the sequence whereby each batch of products is produced without there being a step of mechanically mixing the products or parts or components thereof.

19. The method of printing of claim 18 wherein sequencing the images in a sequence includes generating a random sequence.

20. The method of printing of claim 18 wherein sequencing the images in a sequence includes generating a serial sequence.

21. The method of printing of claim 18 wherein sequencing the images in a sequence includes providing a specified frequency for each image.

22. The method of printing of claim 18 wherein positioning at least one printer includes positioning a drop-on-demand inkjet printer.

23. The method of printing of claim 18 wherein providing a plurality of different images includes providing an image that includes text.

24. The method of printing of claim 18 wherein providing a plurality of different images includes providing an image that includes a graphic.

25. The method of printing of claim 18 wherein providing a plurality of different images includes providing an image that includes both text and a graphic.

* * * * *